US008266845B2

(12) United States Patent
Desjoyaux et al.

(10) Patent No.: US 8,266,845 B2
(45) Date of Patent: Sep. 18, 2012

(54) DEVICE FOR PRODUCING ABOVE GROUND OPEN OR CLOSED STRUCTURES

(76) Inventors: Pierre-Louis Desjoyaux, La Fouillouse (FR); Dung Hoan Tuan, Hanoi (VN); Jean-Paul Saccucci, Veauche (FR)

( * ) Notice: Subject to any disclaimer, the term of this patent is extended or adjusted under 35 U.S.C. 154(b) by 1062 days.

(21) Appl. No.: 11/571,874

(22) PCT Filed: Jul. 9, 2004

(86) PCT No.: PCT/FR2004/050322

§ 371 (c)(1),
(2), (4) Date: Aug. 30, 2007

(87) PCT Pub. No.: WO2006/016015

PCT Pub. Date: Feb. 16, 2006

(65) Prior Publication Data

US 2008/0127580 A1 Jun. 5, 2008

(51) Int. Cl.
*E04B 1/00* (2006.01)

(52) U.S. Cl. ..... 52/167.7; 52/780; 405/107; 405/285; 256/19

(58) Field of Classification Search ..... 52/169.7, 52/169.9, 169.1, 169.3, 169.4, 780, 781; 405/284, 285, 16, 107, 110, 112, 114, 116, 405/117; 256/19
See application file for complete search history.

(56) References Cited

U.S. PATENT DOCUMENTS

| | | | | | |
|---|---|---|---|---|---|
| 635,185 | A | * | 10/1899 | Weyhe | 403/243 |
| 3,381,483 | A | * | 5/1968 | Huthsing, Jr. | 405/262 |
| 3,869,868 | A | * | 3/1975 | Irsai | 405/285 |
| 4,913,594 | A | * | 4/1990 | Sigourney | 405/285 |
| 5,158,399 | A | * | 10/1992 | Flores | 405/285 |
| 6,042,301 | A | * | 3/2000 | Sovran | 405/112 |
| 6,098,352 | A | * | 8/2000 | Coffen | 52/169.7 |
| 6,371,699 | B1 | * | 4/2002 | Weinreb | 405/262 |
| 6,443,655 | B1 | * | 9/2002 | Bennett | 405/114 |
| 2002/0108336 | A1 | * | 8/2002 | Maimon et al. | 52/309.9 |
| 2006/0010819 | A1 | * | 1/2006 | Irvine et al. | 52/583.1 |

FOREIGN PATENT DOCUMENTS

| | | | |
|---|---|---|---|
| CA | 2 246 938 | A1 | 3/2000 |
| EP | 0 742 327 | A | 11/1996 |
| FR | 2 376 276 | A | 12/1976 |
| FR | 2 839 334 | A | 11/2003 |

* cited by examiner

*Primary Examiner* — William Gilbert
(74) *Attorney, Agent, or Firm* — Heslin Rothenberg Farley & Mesiti P.C.

(57) ABSTRACT

Flat panels formed by an assembly of wooden plates include arrangements for integrating rigidity inserts for the assembly thereof. Vertical edges of the panels receive profiles for connecting to adjacent panels in a linear and/or angular alignment manner.

13 Claims, 10 Drawing Sheets

DEVICE FOR PRODUCING ABOVE GROUND OPEN OR CLOSED STRUCTURES

CROSS REFERENCE TO RELATED APPLICATIONS

This application is a 371 filing of International application PCT/FR2004/050322 filed on Jul. 9, 2004 and published, in French, as International publication No. WO 2006/016015 A1 on Feb. 16, 2006, which application is incorporated by reference herein, in its entirety.

BACKGROUND ART

The invention relates to the technical field of manufacturing panels used to produce open or closed structures.

The invention has one advantageous application in the manufacture of swimming pools, especially those of the type known as "aboveground" or "onground" swimming pools, but also other structures, especially timber structures such as huts, chalets, crates, furniture, etc.

Various technical solutions have been suggested for producing structures made of wooden panels. This applies in particularly to aboveground swimming pools with timber frames.

Thus, Patent application FR 02.05815 discloses one advantageous solution.

According to the teaching of this patent application, it is possible to produce swimming pools, especially aboveground pools, by using modular wooden panels of a single type, making it possible to obtain generally complex shapes of any kind and, if applicable, modify their surface area or shape.

To achieve this, the pool is built from wooden panels having vertical ends that have arrangements enabling them to be articulatedly linked together in order to constitute a pool having a generally polygonal shape of any kind. In the case of swimming pool applications, all the assembled panels cooperate with means capable of ensuring leaktightness of the inside walls of the pool and its bottom which is obtained through specific earthworks.

These solutions are satisfactory for producing pools having polygonal shapes of any kind.

Technical solutions that have been suggested to date, for example, for producing aboveground swimming pools with timber frames having a generally circular shape, usually require means that are relatively complex to use and are likely to adversely affect the appearance of the built unit, given the fact that these means are located on the outside of the panels and are visible.

The invention has set itself the object of overcoming these drawbacks in a simple, dependable, effective and efficient manner.

The problem that the invention intends to solve is to make it possible to produce, simply and quickly, panels in particular, merely by way of example, with a timber frame and shape them as required by bending, depending on the general shape of the structure to be produced without the need for any exposed visible means.

The aim was also to improve and facilitate the connection of panels to each other in order to produce closed structures such as aboveground swimming pools.

Another problem that the invention intends to solve is to increase the rigidity of panels, also without the need to use exposed visible means.

BRIEF SUMMARY OF THE INVENTION

In order to solve such a problem, a device for producing aboveground open or closed structures has been perfected, comprising:

flat panels formed by an assembly of wooden plates, in particular;

the wooden plates comprise arrangements for integrating rigidity inserts for the assembly thereof;

the vertical edges of the panels receive profiles for connecting to adjacent panels in a linear and/or angular alignment manner.

Various technical solutions can be envisaged starting from this basic concept, especially with regard to the rigidity inserts and the panel connection profiles. Similarly, it is apparent that the panels are advantageously obtained by assembling vertical or horizontal plates, but not to the exclusion of other embodiments.

To solve the problem of integrating the inserts into the thickness of the panels, in a first embodiment, the rigidity inserts consist of at least one metal bar having a flat cross-section vertically engaged in mortises formed in the thickness of the plates on their opposite-facing juxtaposed surfaces and over their entire length.

In another embodiment, the rigidity inserts consist of a metal profile forming two parallel vertical flanges braced apart by a central support web, said profile being located between the opposite-facing juxtaposed surfaces of the plates over their entire length, the spacing between the flanges matching the thickness of the plates. The central web may be hollow in order to internally accommodate a reinforcing element.

According to this other embodiment, the reinforcing elements protrude at each end of the plates and have shapes allowing connection to matching shapes of the connection profiles of the adjacent panels.

The connection profiles delimit two end areas that each have matching connecting shapes that cooperate with the protruding ends of the reinforcing elements, said end areas being separated by a common area.

Either the common area is shaped so that the two end areas are arranged in alignment and delimit two parallel overlapping wings that correspond to in-line connection of the panels.

Or the common area is shaped so that the two end areas are arranged at an angle and delimit two angular overlapping wings that correspond to angular connection of the panels.

According to another embodiment in terms of the juxtaposed assembly of the panels, the connection profiles have two parallel overlapping wings capable of gripping the section of the panels, said profiles having connecting shapes capable of cooperating with the matching shapes of an intermediate connector.

The intermediate connector is shaped to enable in-line or angular connection of adjacent panels.

According to another aspect, after assembly, the upper parts of the panels are held by a metal profile that sits astride the section of said panels.

In order to solve the problem of producing a curved structure, the panels are flat and capable of being deformed, said panels being fitted with deformable rigidity elements so that they can be held in the desired curved position resulting from deformation of said elements.

According to one advantageous embodiment, the assembly comprises two juxtaposed panels, the deformable rigidity elements being fixed between the panels in a parallel and horizontal manner. In this case, each panel consists of a vertical assembly of wooden plates, the vertical edges of which have, two by two, matching connecting shapes capable of allowing articulation. The panels are of equal or unequal thickness.

Note that only one of the panels may consist of a vertical assembly of wooden plates, the vertical edges of which have, two by two, matching connecting shapes capable of allowing articulation, the other panel being made of a semi-rigid material that can be deformed.

In this case, the panel may be made of wooden plates that are assembled vertically, but preferably, horizontally.

Given the problem to be solved, especially being able to bend the panel, the deformable rigidity elements are in the form of strips or bars that extend over the entire length of the panel, the ends of said elements protruding and being shaped like hinges or loops in order to allow articulated connection of several adjacent panels in combination with a rod.

According to one advantageous application of the invention, connection of the various panels forms a closed structure capable of acting as a pool, especially a swimming pool; the upper straight edges of said panels cooperate with elements that act as a sundeck and, if applicable, are used for fastening a waterproof liner. The deformable rigidity elements are bent in order to form, after assembly of the panels, a pool having a generally circular shape.

BRIEF DESCRIPTION OF THE DRAWING FIGURES

The invention is explained below in greater detail, reference being made to the accompanying drawings in which.

DETAILED DESCRIPTION

Figure 1:
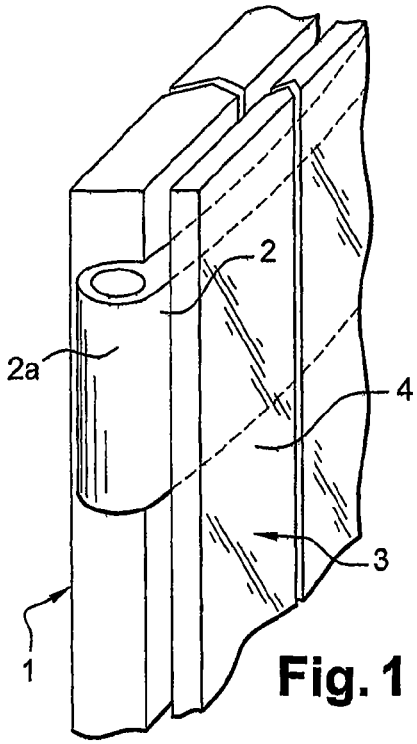
FIG. 1 is a perspective view of a finished assembly consisting of two panels between which deformable rigidity elements are fitted, the assembly being represented after said elements have been bent.
Figure 3:
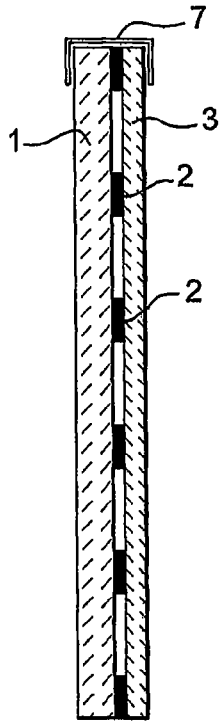
FIG. 3 is a cross-sectional view of the assembly comprising two juxtaposed panels between which rigidity elements are fitted.
Figure 4:
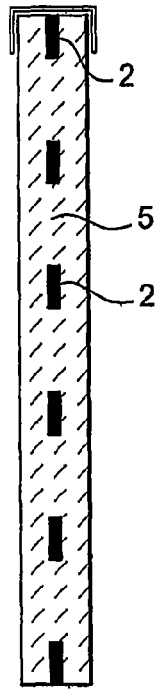
FIG. 4 is a cross-sectional view of an assembly comprising a single panel that has arrangements allowing the integration of deformable rigidity elements in its thickness.
Figure 2:
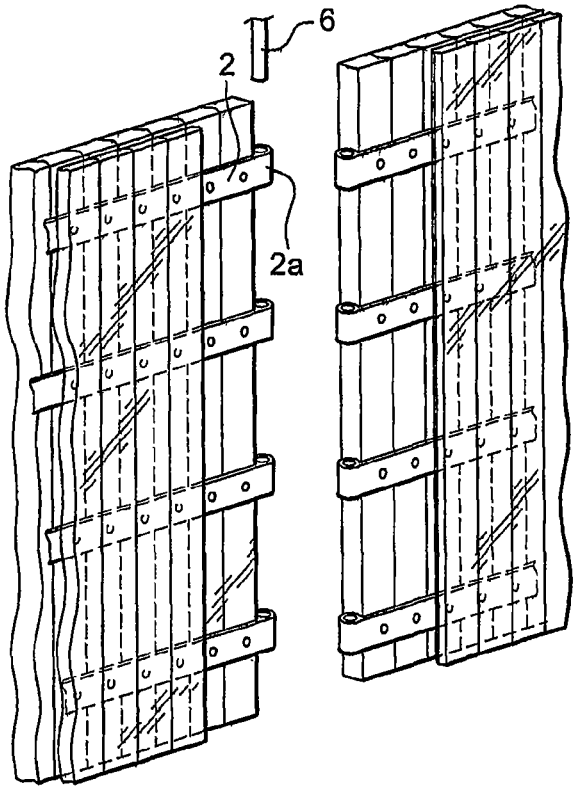
FIG. 2 is a partial perspective view, before assembly, of an embodiment of the assembly before bending of the panels.

In the embodiment shown in FIGS. 1, 2, 3 and 4 in particular, the aim is to produce an assembly for designing various open or closed structures by means of at least one flat panel (P) capable of being deformed in combination with deformable rigidity elements (2). Rigidity elements (2) are selected so that they are elastically deformable with a certain degree of set. For example, these rigidity elements may consist of thin metal strip.

Also, according to another aspect, various rigidity elements (2) are intended to be integrated in the thickness of the assembly. Various embodiments may be envisaged in order to achieve this.

For instance, in one preferred embodiment, the assembly comprises two juxtaposed panels (1) and (3), preferably of the same length and width. Rigidity elements (2) are fixed by any known appropriate means between panels (1) and (3). Panels (1) and (3) are of equal or unequal thickness. Similarly, the design of panels (1) and (3) may be identical or different.

For example, each of the panels (1) and (3) consists of vertically connected wooden plates (4). To allow bending of this assembly, the vertical edges of the plates have, two by two, matching connecting shapes capable of allowing articulation. Note that only one of the panels (1) may consist of a vertical assembly of wooden plates, as indicated earlier. In this case, the other panel (3) is made in the form of a semi-rigid plate so that it can be deformed.

Panels (1) and (3) are assembled together in combination with deformable rigidity elements (2) using any known appropriate means.

In another embodiment where the assembly comprises a single panel (5), the latter has arrangements allowing the integration of deformable rigidity elements (2) in its thickness.

Regardless of the assembly's embodiment, deformable rigidity elements (2) are in the form of strips or bars that extend over the entire length of the panel(s). Elements (2) are preferably distributed at regular intervals over the entire height of the panel(s) in question. Elements (2) are arranged parallel to each other and horizontally.

According to another aspect, the ends of elements (2) protrude beyond the vertical edges of the panel(s) and are shaped like hinges or loops (2*a*) to allow articulated connection of several adjacent panels in combination with a rod (6) in particular. This configuration therefore allows articulated connection of several panels in order to produce a closed structure in particular.

Connecting various panels builds a closed structure capable of acting as a pool, especially a swimming pool. The upper straight edges of the panels can be fitted with separately mounted elements (7) capable of acting as a sundeck and, if applicable, being used to obtain waterproof fastening of sheet known as a liner in the case of the application involving swimming pools.

Figure 5:
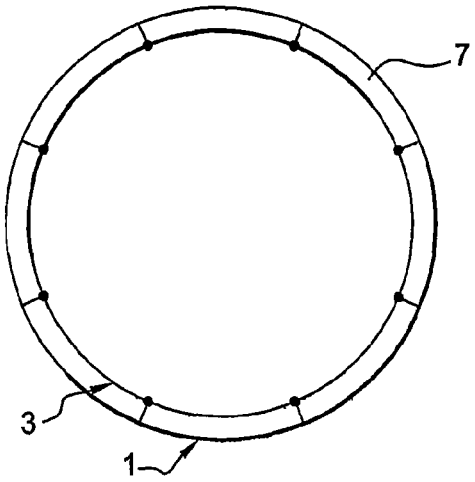
FIG. 5 is a schematic plan view showing one example of a structure built according to the characteristics of the invention in order to produce, in particular, a circular shaped swimming pool.

As shown in FIG. 5, deformable rigidity elements (2) can be bent in order to form, after assembly of the panel(s), a pool having a generally circular shape.

Figure 6:
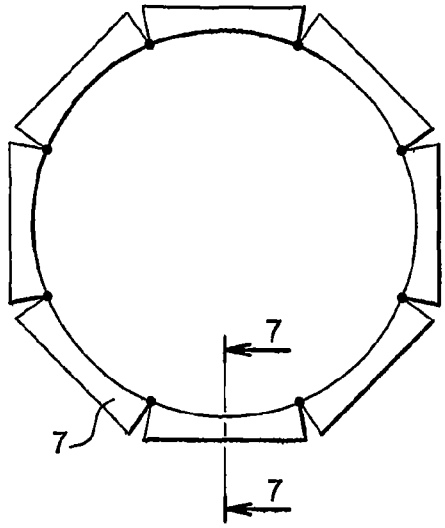
FIG. 6 is a schematic plan view showing another pool shape where the interior is circular and the exterior is polygonal.
Figure 7:
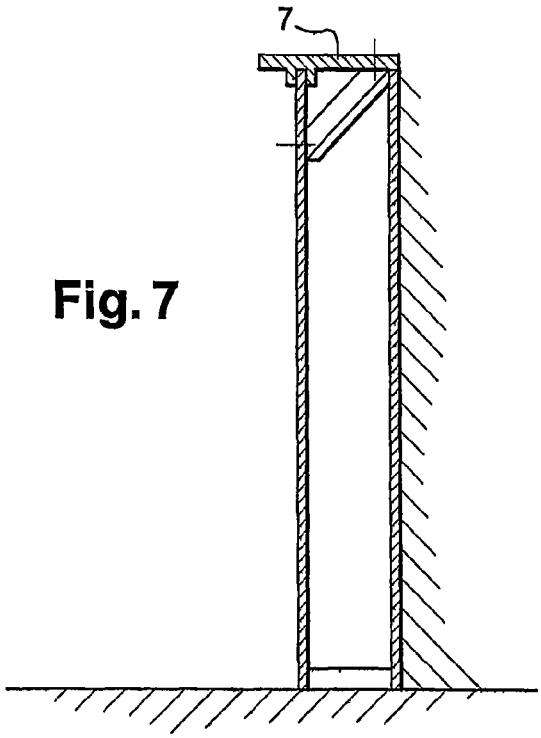
FIG. 7 is a larger-scale cross-sectional view along line 7-7 in FIG. 6.

According to an alternative embodiment, where the assembly is produced by juxtaposing two panels, the panel intended to be located outside the structure acting as cladding can be rigid or at least not be subjected to the process used to deform rigidity elements (2). In this case one can produce a closed structure, for example one with a circular internal shape and a polygonal external appearance (FIG. 6).

The panels may or may not be juxtaposed end to end with interposed spacers that act as a sundeck.

Figure 8:
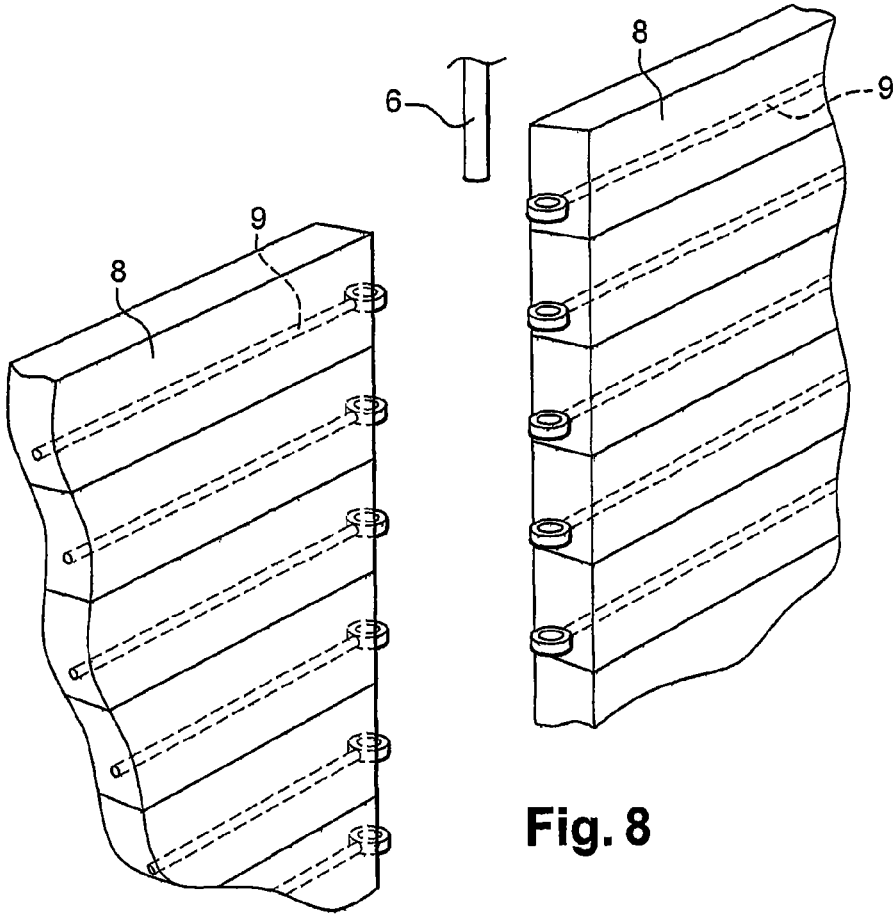
FIG. 8 is a perspective view of another embodiment wherein the panels are produced using wooden plates arranged horizontally and internally reinforced with metal bars.
Figure 9:
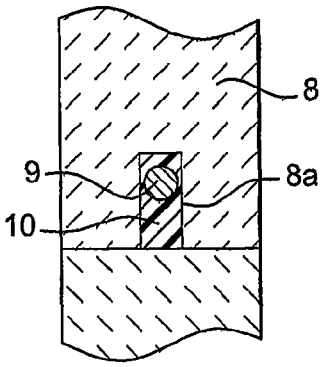
FIGS. 9 and 10 are partial views showing two embodiments to reinforce the wooden plates in accordance with the construction practice in FIG. 8.
Figure 10:
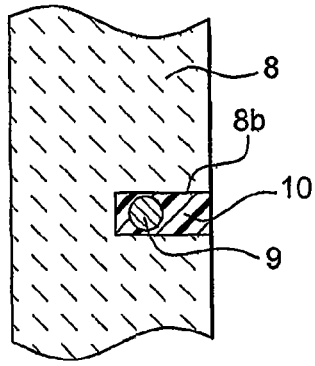

In the embodiment shown in FIGS. 8, 9 and 10, the panels are produced by assembling wooden plates (8) arranged in a horizontal plane. Each plate has at least one metal reinforcing element (9) in the form of a metal bar, for instance. For example, the metal bar of each plate is housed in a vertical mortise (8*a*) (FIG. 9) or horizontal mortise (8*b*) (FIG. 10) and is secured by a synthetic resin mortar (10). In this embodiment, the panels are rigid and can be used to produce, for example, a polygonal shaped closed structure. As indicated earlier, the ends of the bars may have a loop in order to engage an articulation rod.

In the embodiment shown in FIGS. 11, 12 , 13, 14, 15, 16, 17 and 18, the flat panels (P) are produced by assembling wooden plates, in particular, or other elements and have arrangements for integrating rigidity inserts at the time they are assembled.

Figure 11:
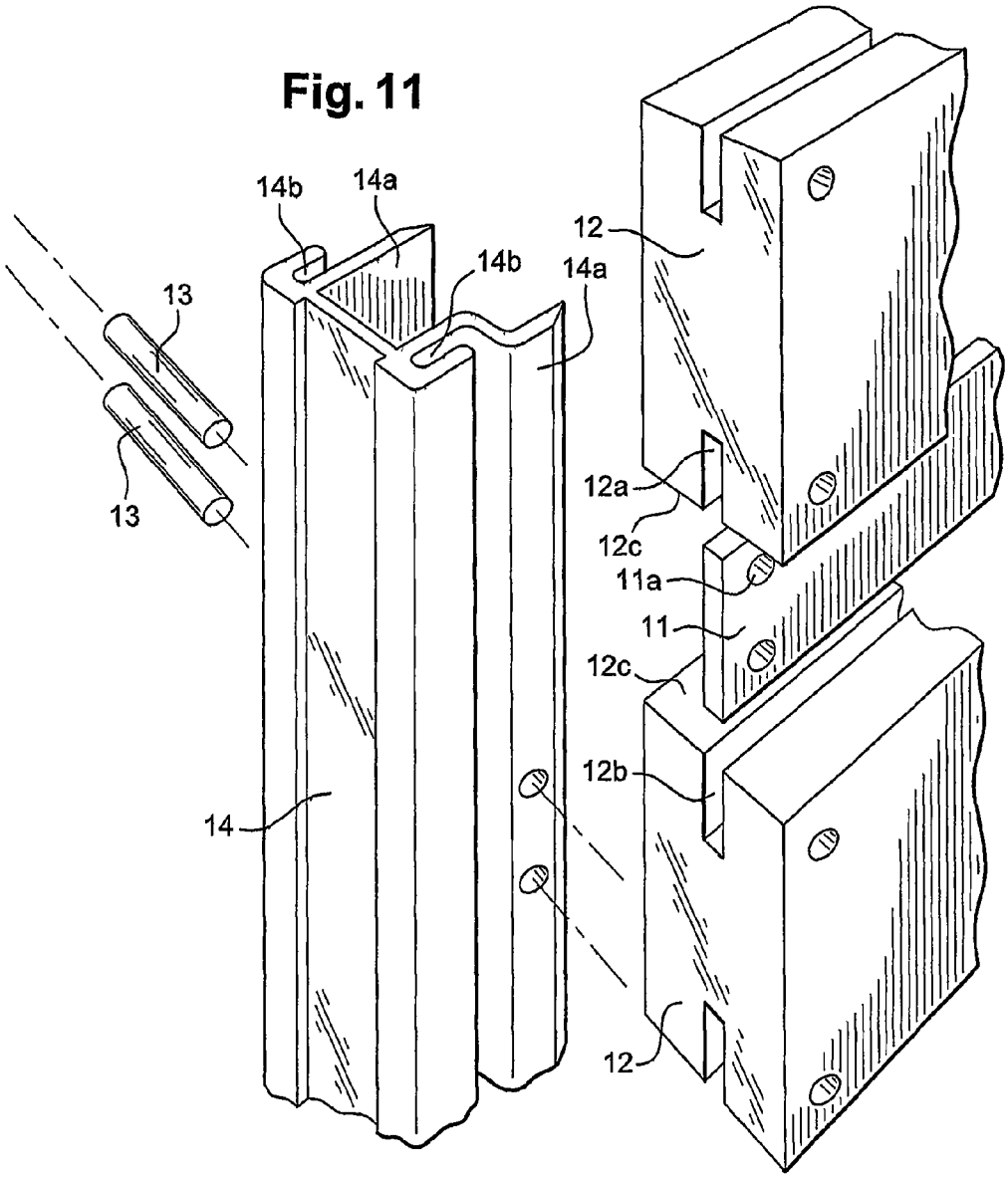
FIG. 11 is a perspective view, before assembly, of the component parts of the panels and the connection profiles in a first embodiment.
Figure 13:
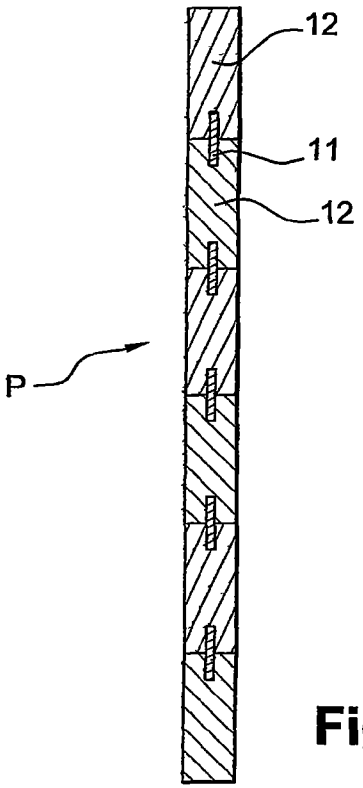
FIG. 13 is a cross-sectional view along line 13-13 in FIG. 12.
Figure 12:
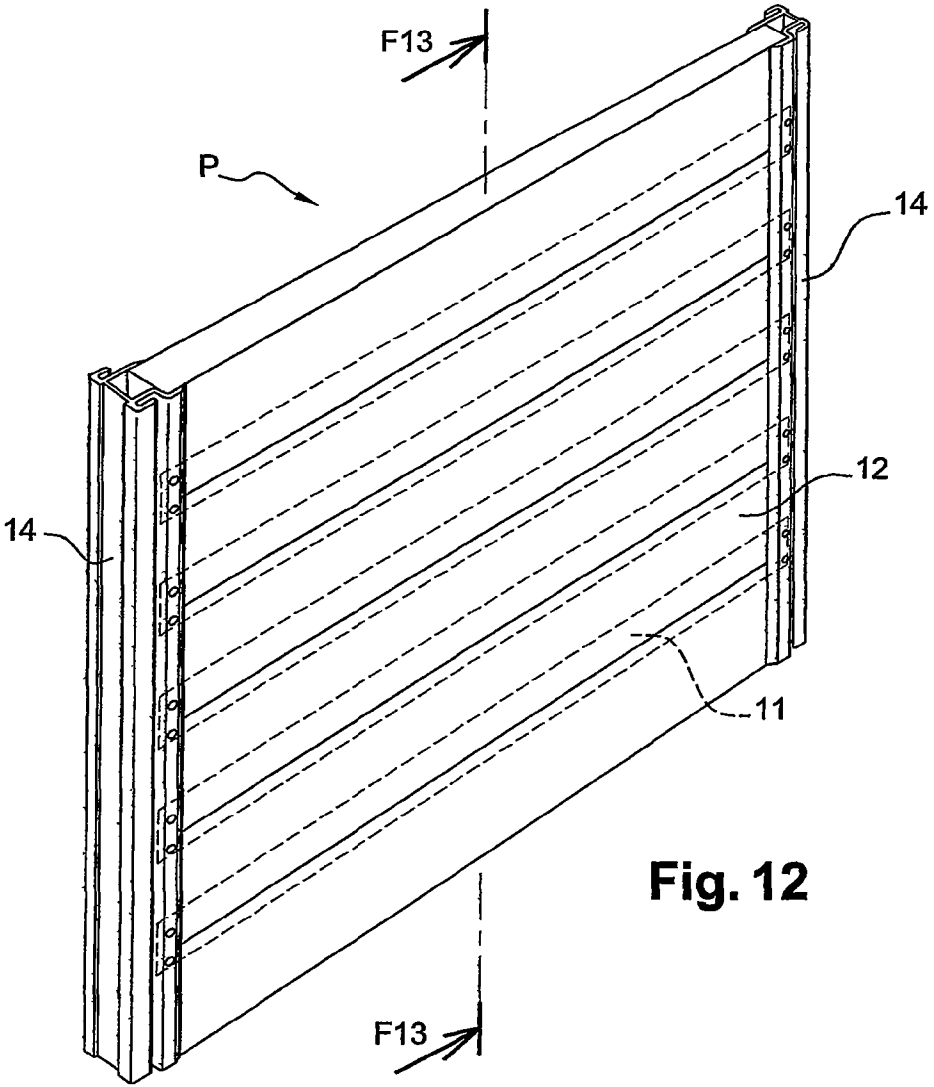
FIG. 12 is a view equivalent to that in FIG. 11 after the various elements have been assembled.

In FIGS. 11, 12 and 13, the rigidity inserts consist of at least one metal bar (11) having a flat cross-section. This bar (11) is vertically engaged in mortises (12*a*) and (12*b*) formed in the thickness of plates (12) on their opposite-facing juxtaposed surfaces (12*c*) and over their entire length. Note that the ends of bars (11) may have holes (11*a*) in order to fit fasteners (13) that pass through the thickness of plates (12) and, if applicable, connection profiles (14) intended to be located on the vertical edges of the panels, as will be indicated later on in this description.

Figure 15:
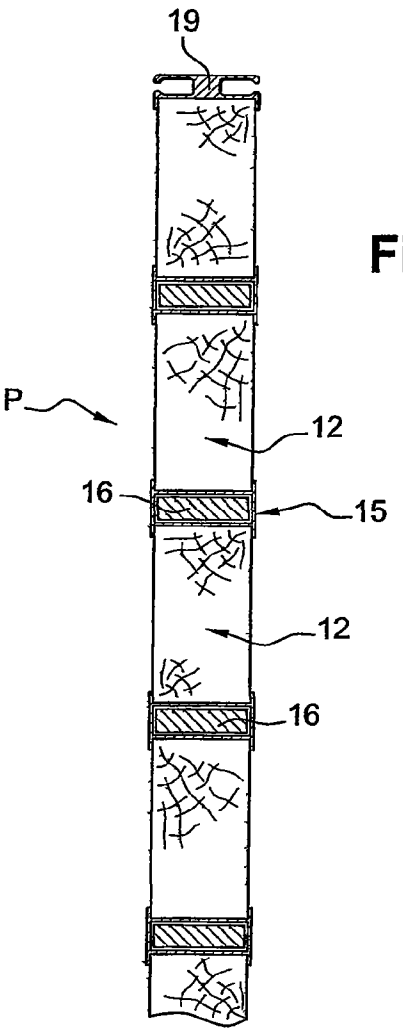
FIG. 15 is a cross-sectional view of the panel in the embodiment illustrated in FIG. 14.
Figure 14:
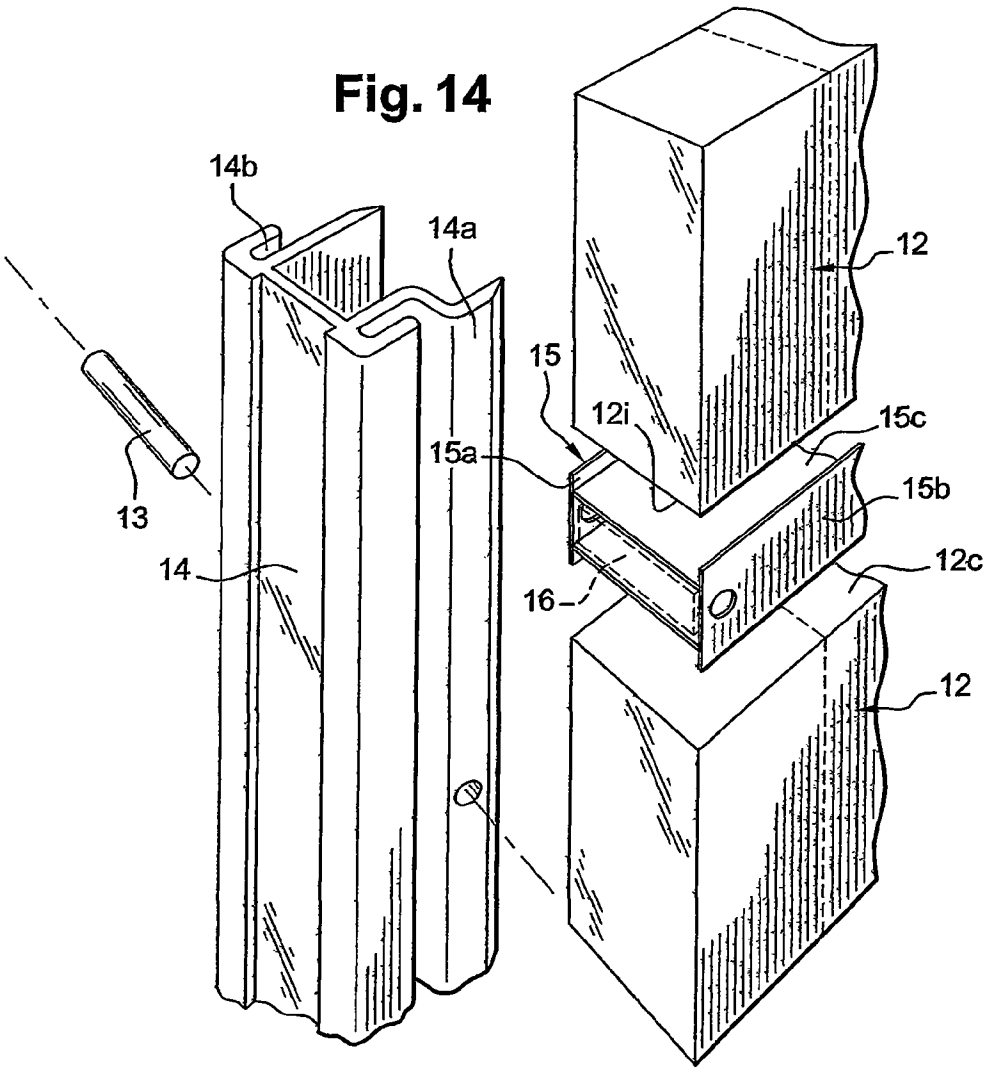
FIG. 14 is a perspective view, before assembly, of the component parts of the panels and the connection profiles in another embodiment.
Figure 16:
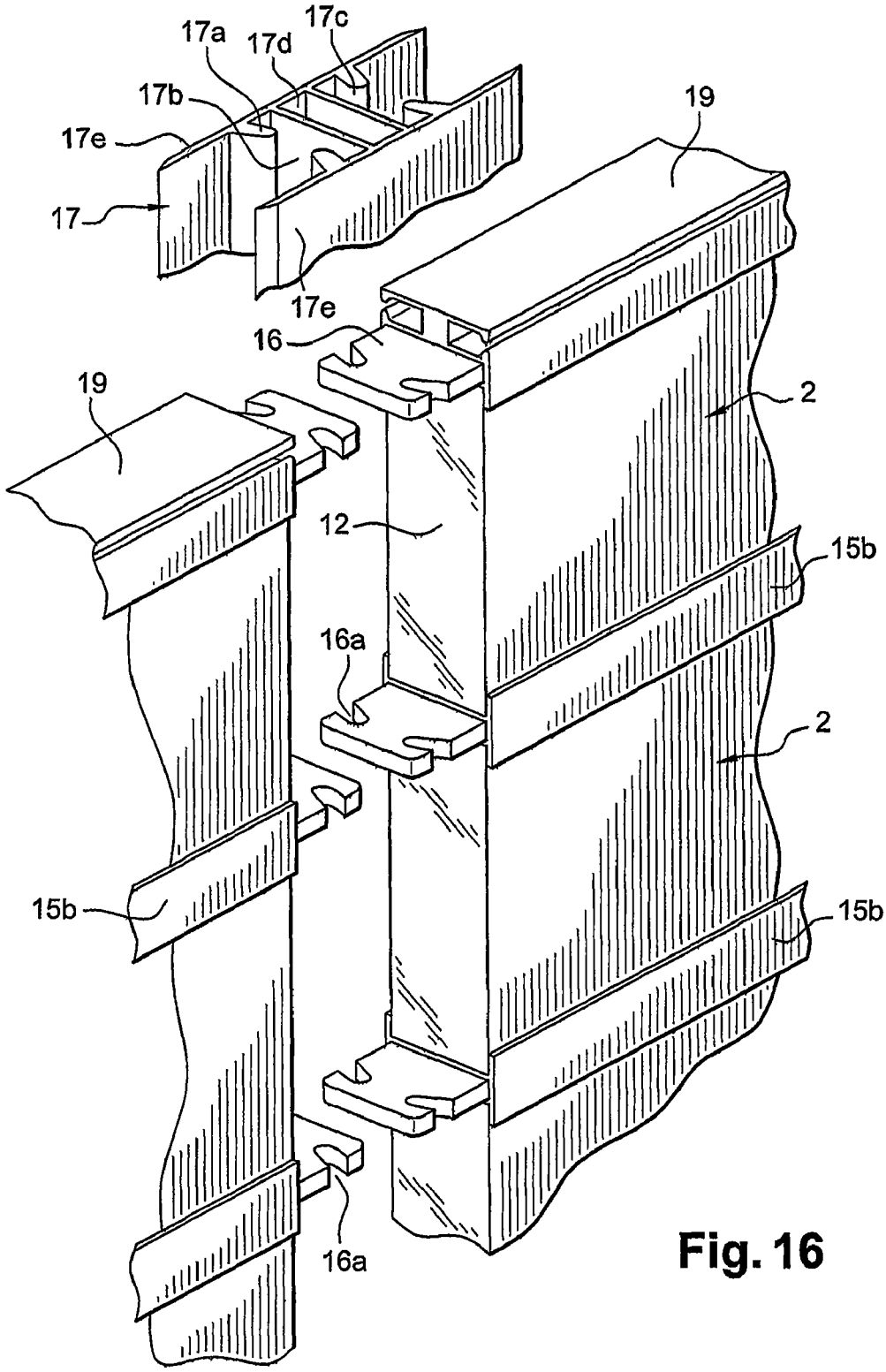
FIG. 16 is a perspective view of an embodiment of the inserts and panel connection profiles—the profiles are partially shown before connection to the matching shapes of the inserts.

FIGS. 14, 15 and 16, in particular, show the rigidity inserts consisting of a metal section (15) that has two parallel vertical flanges (15*a*) and (15*b*) braced apart by a central support web (15*c*). Section (15) is placed between opposite-facing surfaces (12*c*) of plates (12) over their entire length. The spread between flanges (15*a*) and (15*b*) matches the thickness of plates (12). Central support web (15*c*) may advantageously be hollow to accommodate a reinforcing element (16) in the form, for example, of a horizontal metal bar. As indicated earlier, inserts (15) may be fixed in combination with connection profiles (14) by means of fasteners (13).

Figure 18:
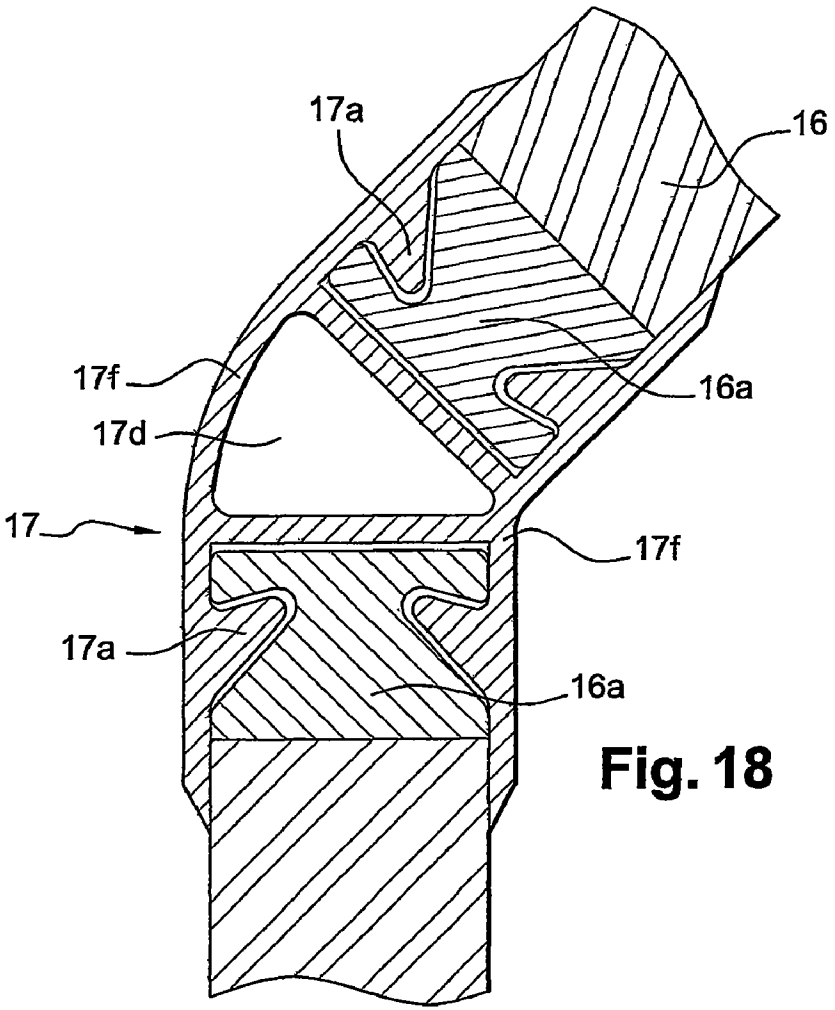
FIG. 18 is a view similar to FIG. 17 where the panels are connected at an angle.
Figure 17:
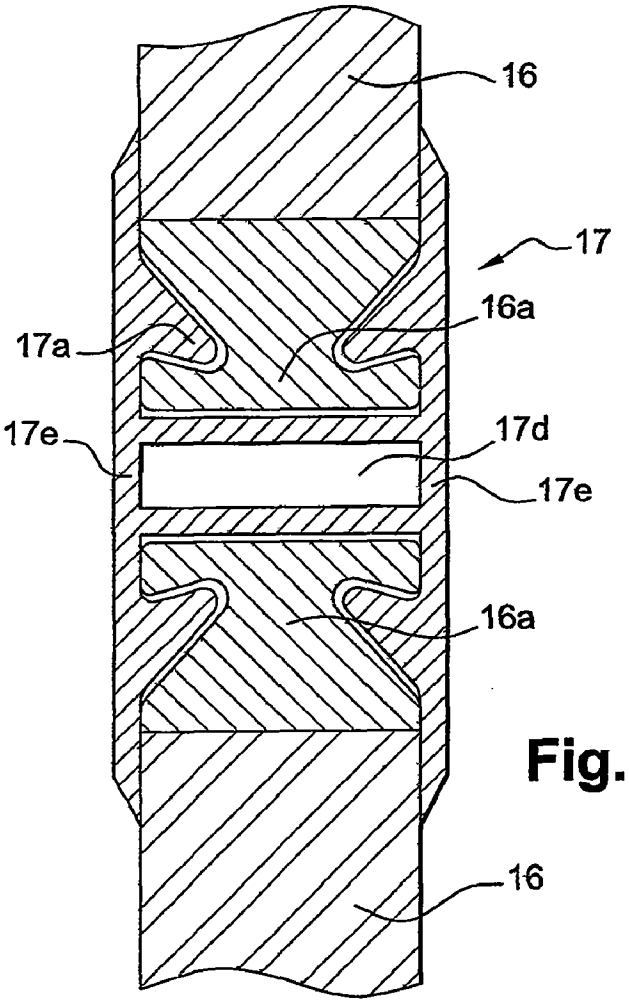
FIG. 17 is a partial cross-sectional view showing connection of the panels in the embodiment illustrated in FIG. 16 where the panels are connected in alignment.

In the embodiment illustrated in FIGS. 16, 17 and 18, reinforcing elements (16) protrude at each end of plates (12) and, on this protruding part, have connecting shapes (16*a*) that cooperate with matching shapes (17*a*) of another type of connection profile (17). These connection profiles (17) delimit two end areas (17*b*) and (17*c*) each having matching connecting shapes (17*a*). End areas (17*b*), (17*c*) are separated by a common area (17*d*).

Starting from this basic concept of connection profile (17), several embodiments are provided for connecting panels in linear alignment or connecting panels at an angle.

In FIGS. 16 and 17, common area (17*d*) is shaped so that the two end areas (17*b*) and (17*c*) are arranged in alignment and delimit two parallel overlapping wings (17*e*), the spacing of which corresponds to the thickness of the panels.

In FIG. 18, common area (17*d*) is shaped so that the two end areas (17*b*) and (17*c*) are arranged at an angle and delimit two angular overlapping wings (17*f*), the spacing of which, as previously, corresponds to the thickness of the panels.

In another embodiment (FIGS. 11 and 14), connection profiles (14) have two parallel overlapping wings (14*a*) capable of gripping the section of the panels. Profiles (14) have connecting shapes (14*b*) capable of cooperating with matching shapes (18*a*) of an intermediate connector (18). Connecting shapes (14*b*) (18*a*) are designed to allow in-line or angular connection.

Figure 19:
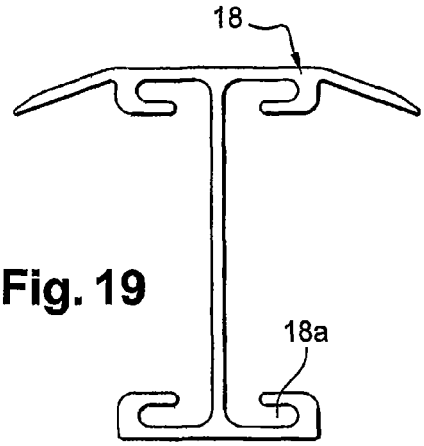
FIG. 19 is a top view of an intermediate connector where the panels are connected in alignment.
Figure 20:
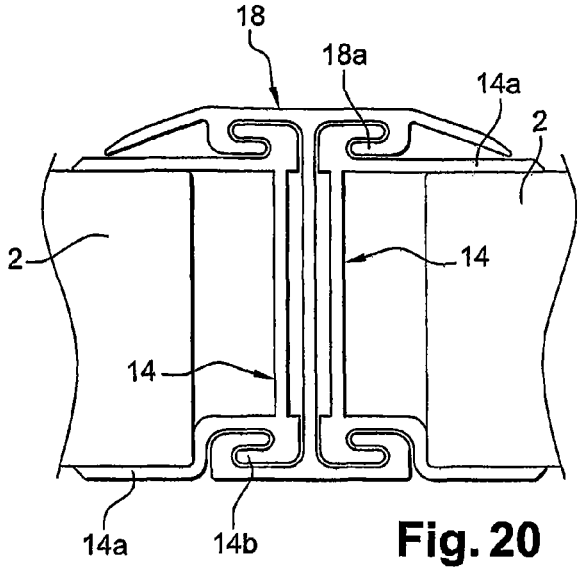
FIG. 20 shows connection of the intermediate connector to an end profile.

In FIGS. 19 and 20, intermediate connector (18) is shaped to allow in-line connection of the panels.

Figure 21:
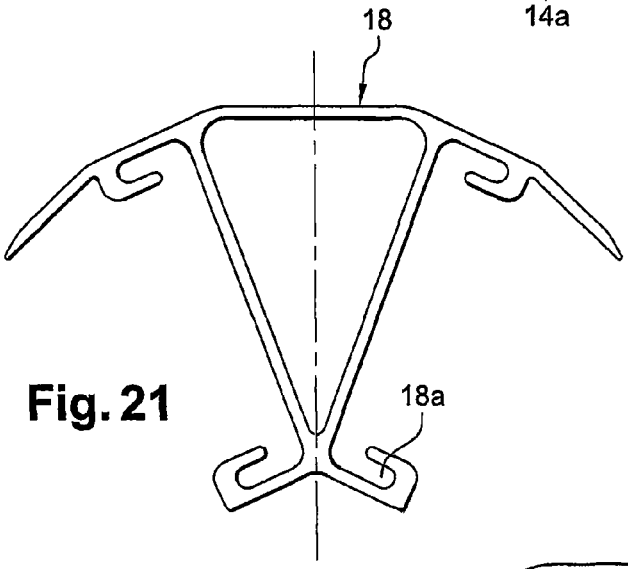
FIG. 21 is a top view of an intermediate connector where the panels are connected at an angle.
Figure 22:
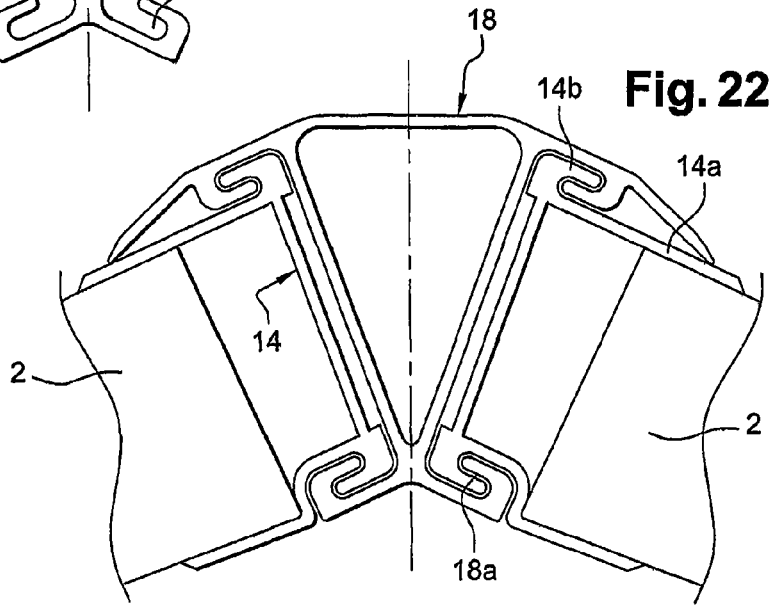
FIG. 22 shows connection of the intermediate connector to an end profile.
Figure 23:
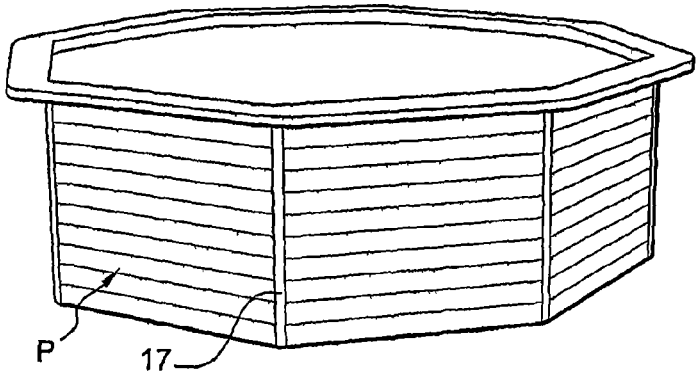
FIGS. 23, 24 and 25 are perspective views, merely by way of example, of various closed structures used to produce aboveground swimming pools.
Figure 24:
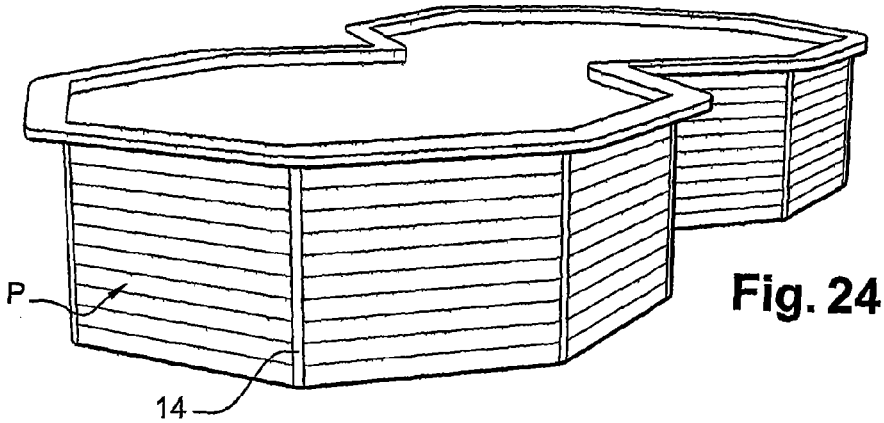
Figure 25:
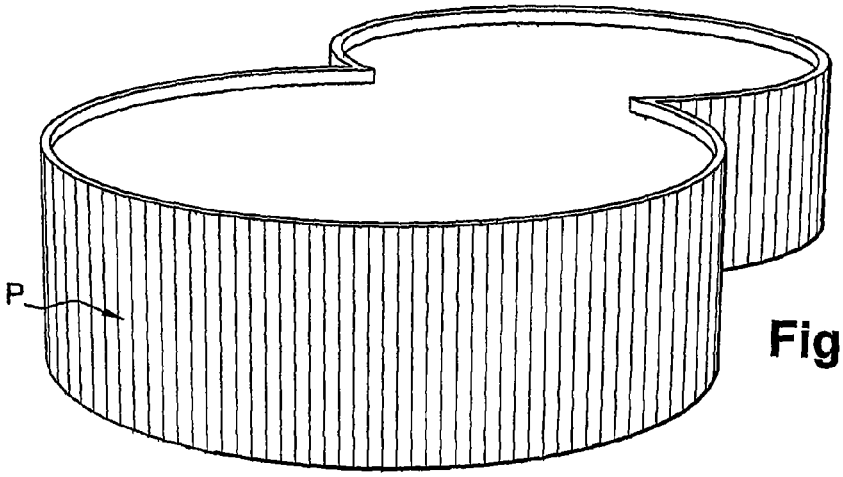

In FIGS. 21 and 22, intermediate connector (18) is shaped to allow angular connection of the panels.

As already indicated, after assembly, the upper parts of the panels are held by a metal profile (19) that sits astride the section of said panels.

Its advantages are readily apparent from the description, the following features in particular being emphasised and underlined:

- in particular the possibility of producing a structure having a generally circular or curved shape by using, in particular, wooden panels without requiring the use of exposed visible elements likely to have an adverse effect on the appearance of the assembly;
- simplicity of use and ease with which the panel can be shaped;
- quick and simple assembly;
- possibility of producing upgradeable modular shapes;
- polygonal-shaped cladding makes it possible to obtain polygonal external appearance based on a round shape;
- space savings during transport and storage;
- possibility of producing rigid panels having internal reinforcement;
- elimination of external reinforcement;
- possibility of producing open or closed structures in order to manufacture various products such as: reservoirs, swimming pools, flower containers, waste bins, sand pits, etc.

The invention claimed is:

1. Device for producing aboveground open or closed structures comprising:

- flat panels formed by an assembly of stacked wooden plates, each plate of at least two adjacent plates of the stacked wooden plates of a first panel of the flat panels having a height greater than a thickness of the plate;
- a connection profile receiving vertical edges of the first panel of said flat panels for connecting the first panel to an adjacent panel in a linear or angular alignment, wherein the plates of at least the first panel are fitted with rigidity inserts between adjacent plates, the rigidity inserts comprising a metal profile having two parallel vertical flanges braced apart by a central support web, said metal profile being located between opposite-facing juxtaposed faces of the adjacent plates over an entire length of said plates, spacing between the flanges matching a thickness of the plates, and each of the vertical flanges of a rigidity insert located between the at least two adjacent plates having a height less than a height of an adjacent plate leaving a portion of a vertical side face of the plate, parallel and adjacent the vertical flange, exposed; and the connection profile having two overlapping parallel wings for gripping a section of the first panel, and having connecting shapes cooperating with matching shapes of an intermediate connector.

2. A device as claimed in claim 1, wherein connection of the panels forms a closed structure acting as a pool, upper straight edges of said panels cooperating with elements that act as a sundeck.

3. A device as claimed in claim 2, wherein the upper straight edges of said panels cooperating with elements that act as a sundeck are adapted for fastening a waterproof liner.

4. A device as claimed in claim 1, wherein the portion comprises a majority of the vertical side face of the plate.

5. The device as claimed in claim 1, wherein the intermediate connector is shaped to allow in-line or angular connection of adjacent panels.

6. The device as claimed in claim 1, wherein the panels are flat and capable of being deformed, said panels being fitted with deformable rigidity inserts so that the panels can be held in a desired curved position resulting from deformation of said inserts.

7. The device as claimed in claim 6, comprising two juxtaposed panels, the deformable rigidity inserts being fixed between the panels parallel to each other and horizontally.

8. The device as claimed in claim 6, wherein each panel comprises a vertical assembly of wooden plates, vertical edges of the plates having, two by two, matching connecting shapes allowing articulation.

9. The device as claimed in claim 6, wherein one of the panels comprises a vertical assembly of wooden plates, vertical edges of the plates have, two by two, matching connecting shapes allowing articulation, and an other panel is made of a semi-rigid material so that the other panel can be deformed.

10. The device as claimed in claim 6, wherein the deformable rigidity inserts comprise strips or bars that extend over an entire length of the panel, ends of said inserts protruding and being shaped by hinges or loops in order to allow articulated connection of several adjacent panels in combination with a rod.

11. The device as claimed in claim 1, wherein the intermediate connector is separate from the connection profile, and the connecting shapes interconnect with the matching shapes.

12. The device as claimed in claim 11, further comprising a second connection profile having two overlapping parallel wings for gripping a section of the adjacent panel, and having connecting shapes interconnecting with second matching shapes of the intermediate connector.

13. The device as claimed in claim 1, wherein at least one of the connecting shapes and the matching shapes comprises a hook shaped part.

* * * * *